US005454829A

United States Patent [19]

Koland

[11] Patent Number: 5,454,829

[45] Date of Patent: Oct. 3, 1995

[54] PIERCED EAR LOBE SAVER

[76] Inventor: Judith M. Koland, 10601 Hulser Rd. Lot #176, Utica, N.Y. 13502

[21] Appl. No.: 189,092

[22] Filed: Jan. 31, 1994

[51] Int. Cl.[6] ..... A61B 17/00; A44C 7/00

[52] U.S. Cl. ..... 606/188; 63/12

[58] Field of Search ..... 606/188; 63/12

[56] References Cited

U.S. PATENT DOCUMENTS

| | | | |
|---|---|---|---|
| 3,500,829 | 3/1970 | Abramowitz | 606/188 |
| 4,274,416 | 6/1981 | Sorensen | 606/188 |
| 5,018,365 | 5/1991 | Luceno . | |
| 5,154,068 | 10/1992 | DiDomenico . | |

FOREIGN PATENT DOCUMENTS

| | | | |
|---|---|---|---|
| 0009732 | of 1902 | United Kingdom | 606/188 |

*Primary Examiner*—Stephen C. Pellegrino
*Assistant Examiner*—William Lewis

[57] ABSTRACT

An improved protective device for pierced ears designed for insertion through wearer's lobe from the back of the lobe to the front where it receives the metal post of a conventional pierced earring, said device comprising an elongated hollow cylinder of hypoallergenic material, open on both ends mounted on which is a disc to allow for adjustment of the distance on said cylinder between its forward end and the back surface of the wearer's lobe. At the rear end of the cylinder is formed a clutch portion to receive and removably grip the earring post.

4 Claims, 2 Drawing Sheets

PIERCED EAR LOBE SAVER

BACKGROUND

1. Field of Invention

This invention relates to earring jewelry, specifically to an improved device for pierced ear lobe protection.

2. Discussion of Prior Art

In the current market pierced-ear earrings are generally preferred by the consumer over the clip-on and screw-back types so common in years past.

This is because there are advantages to pierced earrings:

Security They are less likely to become inadvertently detached from the wearer's lobe and lost. The value of this feature increases as the value of the earrings increases.

Style and Selection The selection of fashion earrings representing the latest trends is far greater for those who can wear pierced earrings and certain styles of pierced earrings simply do not lend themselves to the clip-on type of earring with its heavier, larger decorative front portion, hinge, and spring-loaded clip. The beautiful and delicate gemstone stud so popular as a pierced earring is a good example. Pierced earrings are an especially popular choice for young girls and even babies whereas the other types of earrings would be inappropriate.

Comfort After the initial discomfort of the ear piercing technique, pierced earrings are generally much more comfortable to wear than the aforementioned pressure types and can be worn all the time by people who have no problem with allergy or irritation.

However, the conventional pierced-ear earring with its metallic post inserted through the lobe from front to back and secured in place by means of a gripping piece positioned on the post at the back of the lobe poses problems of its own.

These problems prevent many women, children, and men who have gone ahead and had their ears pierced in order to enjoy the fashion, comfort, and security benefits mentioned, from ever wearing the earrings at all:

(a) One such long recognized problem is the allergic reaction that often occurs as a result of contact between the skin in and around the pierced hole and the alloyed or plated metals of the earring's post and clutch. Writing as one who has suffered with this reaction, this applicant knows that the itching, redness, pain, and oozing of lobes so affected can persuade a weary wearer to quit wearing earrings altogether.

(b) Another problem is caused by the repeated insertion of the metal post through the lobe in order to change the decorative front portion. Unsightly and painful irritation, infection, and scarring can result.

(c) The angle at which the gun shoots the lobe-piercing earring in the conventional piercing procedure makes locating that channel through the lobe difficult for some wearers and manipulating the lobe to see where the post should emerge only adds to the problem.

(d) The selection of styles, variety, and the fashion fun of pierced earrings is sharply diminished if the wearer must limit purchases to those earrings formed of gold as they are prohibitively expensive.

(e) The sharp metal curled edges and thin, pointy shafts behind the ear when the earring is in place make them uncomfortable to sleep in and moreso for little children.

(f) These same edges and points can snag on sweaters and shirts put on and taken off over the head causing pulling and pain.

(g) The tiny clutch members of conventional pierced earrings are hard to handle and easy to lose.

Efforts have been made to overcome some of these problems. Addressing problem (a) only, posts have been manufactured utilizing metals such as surgical steel but this has not been successful in eliminating the aforementioned allergic reactions and irritations.

Prior art has responded to problem (a) by providing a hypoallergenic sheath, such as tubular plastic, that surrounds the metallic post of the pierced earring to provide a barrier between the post and wearer's ear. U.S. Pat. No. 4,067,341 (1978) to Ivey is illustrative of this technique, but the disadvantage is that the protector is mounted on the post or wire of the earring and then forced through the wearer's lobe as a unit. There is no teaching in the patent of leaving the tube in the wearer's lobe for use again and again with various pierced earrings.

Moreover, mounting this plastic sleeve onto the metallic post creates an even thicker shaft with a discernible edge where the tube ends. To thread and rethread this configuration through the already sensitive lobe everytime a change of the decorative earring is desired exacerbates problem (b) in its attempt to solve problem (a).

U.S. Pat. Nos. 5,018,365 to Luceno (1991) and 5,154,068 to DiDomenico (1992) broadly teach the concept of utilizing some kind of hypoallergenic tubular sleeve within the wearer's pierced earlobe that in effect serves as a permanent or semi-permanent liner to receive the metallic post of a pierced earring in order to solve problems (a) and (b).

They differ from or fall short of the present applicant's invention in these ways:

(a) Both are positioned into the lobe from front to back until a wide lip or flange rests against the front lobe surface. This unsightly flange is always there and with many styles of pierced earring remains visible even when the earring is in place. Even though this flange may be star-shaped or otherwise decorative it is not a desirable feature.

(b) Both feature small, separate pieces that are hard to handle. These tiny pieces are also easy to lose. The Luceno patent teaches that a conventional clutch is not used but rather instead the small, threaded clutch member of her invention. It is claimed also that both members be formed of a precious metal such as gold. Loss of this tiny piece would therefore render the device useless and would represent some monetary loss for the wearer.

(c) Also, the closed end of the Luceno clutch member severely limits adjustability for varying lobe thicknesses or where increased or decreased snugness between the lobe and the decorative earring is desired as in heavier or larger ornamental earrings requiring more tension against them.

(d) The DiDomenico patent features three tiny, separate pieces. I believe it would be hard to handle and easy to lose the clutch member of the embodiment.

Thereafter, the grasp that a conventional clutch piece would have on a conventional pierced earring post (9 mm.) after space on said post is first given over to a front flange, an earlobe of average thickness and a back flanged piece would be precarious.

OBJECTS AND ADVANTAGES

Accordingly, several objects and advantages of my invention are:

(a) to provide for those who wish to wear pierced-ear earrings but who suffer from contact dermatitis or allergies a hypoallergenic barrier between the earlobe and the metal post of a pierced earring;

(b) to provide a protector for the earlobe which when inserted into the lobe's pierced hole may be considered to be semi-permanently inserted and be used again and again with each succeeding choice of pierced earring;

(c) to provide a protective tube for the pierced earlobe which does not require a visible flange on the front surface of the lobe;

(d) to provide a protector for pierced ears which may be used on earlobes of varying thicknesses;

(e) to provide a protective apparatus which can be adjusted to create increased snugness between the lobe and certain pierced earring decorative fronts;

(f) to provide a protective tube for the pierced ear that has a round, smooth end for easy insertion through the lobe;

(g) to provide a protector for pierced earlobes which is easy to grasp and of one piece embodiment;

(h) to provide a protective device for pierced ears that is durable, simple and economical to manufacture;

(i) to provide the consumer with a relatively low cost earlobe protector that will allow the metal-sensitive wearer the fashion and low cost of costume jewelry earrings;

(j) to provide a protective liner for the pierced earlobe the back of which is smooth, round, and comfortable.

Further objects and advantages of my invention will become apparent from a consideration of the drawings and ensuing description.

DRAWING FIGURES

DESCRIPTION OF THE PREFERRED EMBODIMENT

Figure 1:
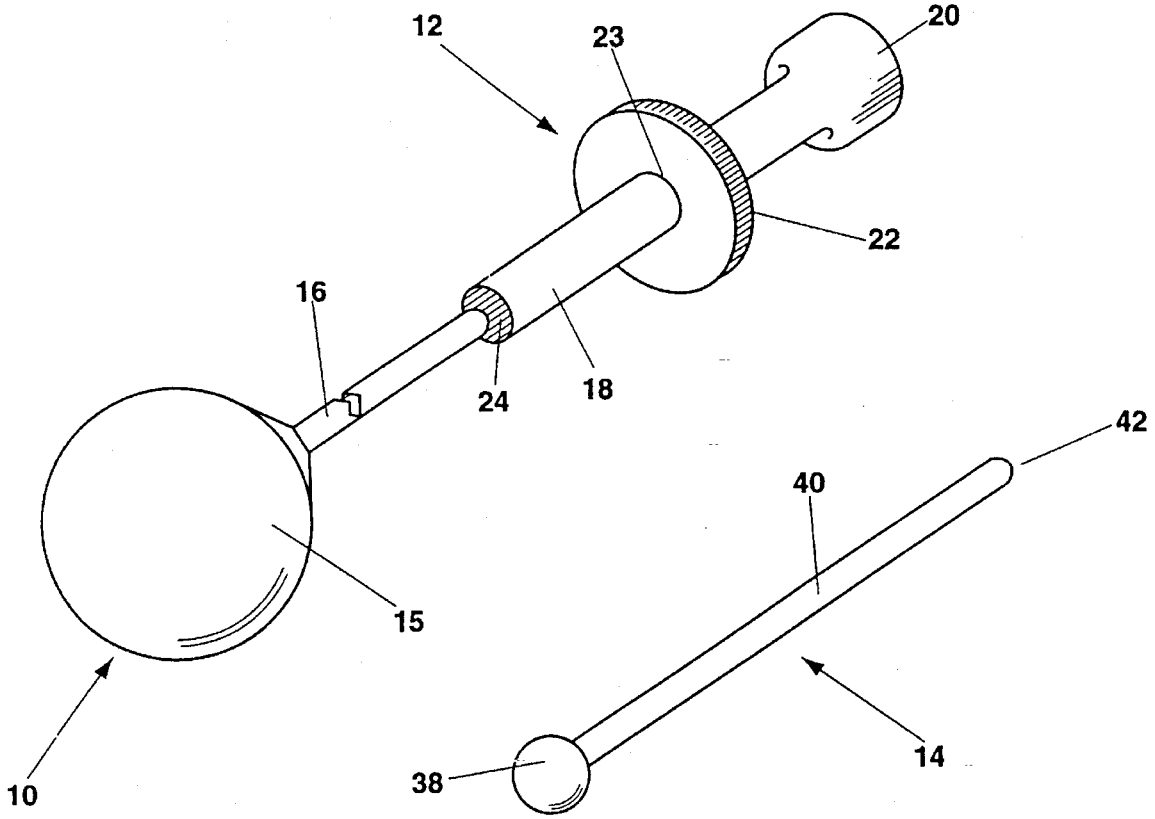
FIG. 1 is a perspective view showing the protective device of the invention, the insertion pin, and a pierced earring.

Referring to FIG. 1 a pierced earring is shown generally at 10; the pierced-ear lobe protector device is shown generally at 12; and a ball-headed insertion pin is shown generally at 14.

Pierced earring 10 is of conventional construction and comprises an ornamental portion 15 and a metal post or stem portion 16.

The lobe protector 12 of the invention comprises an elongated, hollow cylinder 18 which is open at both the anterior and posterior ends. Said hollow cylinder 18 is constructed of a hypoallergenic metal such as gold which has proven itself compatible with human tissue.

Figure 2:
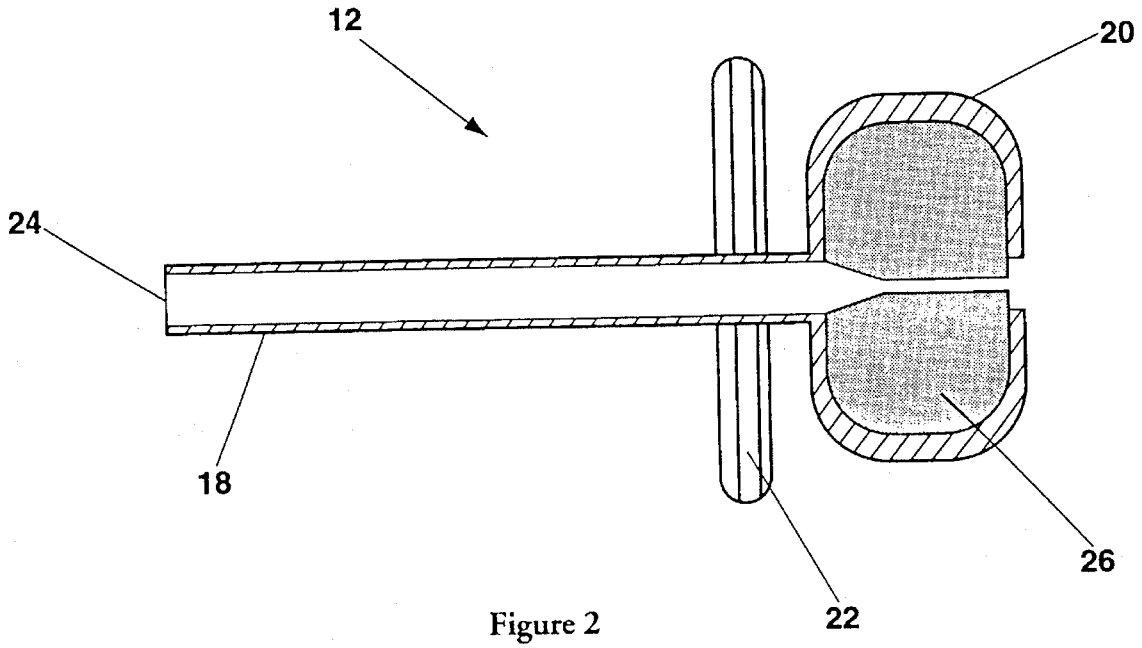
FIG. 2 is a side elevation of the device, cut away.

The posterior end of cylinder 18 is molded to form a bulbous enlargement which forms the outer case of clutch portion 20. The cavity formed therein contains a gripping piece formed of an elastomeric compound 26, as best shown in FIG. 2, which receives and frictionally secures the metal post 16 of earring 10. The total length of cylinder 18 including clutch portion 20 is approximately the length of post 16.

Forward of clutch portion 20 is the adjustment disc 22, formed of a resilient elastomeric material. An internal bore 23 extends axially through disc member 22. Said bore 23 is dimensioned so as to effect frictional interlock between said disc 22 and cylinder 18 while yet allowing some movement when urged.

Insertion pin 14 comprises a ball-shaped head 38 and a shaft 40. Said shaft 40 may be formed of less expensive base metals since it does not contact the wearer's skin but head 38 is formed of or coated with a non-irritating substance. Shaft 40 is the approximate girth of metal post 16 and somewhat longer. Ball head 38 is of a diameter just slightly larger than the diameter of aperture 24 at the front extremity of hollow cylinder 18.

OPERATION OF INVENTION

It is understood that the wearer's earlobe shall have been previously and suitably pierced by known techniques.

Tip 42 of shaft 40 of insertion pin 14 shall be fed into aperture 24 at the front end of hollow cylinder 18. Said shaft 40 shall travel through the length of cylinder 18 until the ball head abuts the front of cylinder 18, forming a round, smooth tip.

Leading with this tip, the lobe protector device 12 shall then be inserted into the back of the earlobe through to the front until it extends beyond the front surface 32 of earlobe 28.

Figure 3:
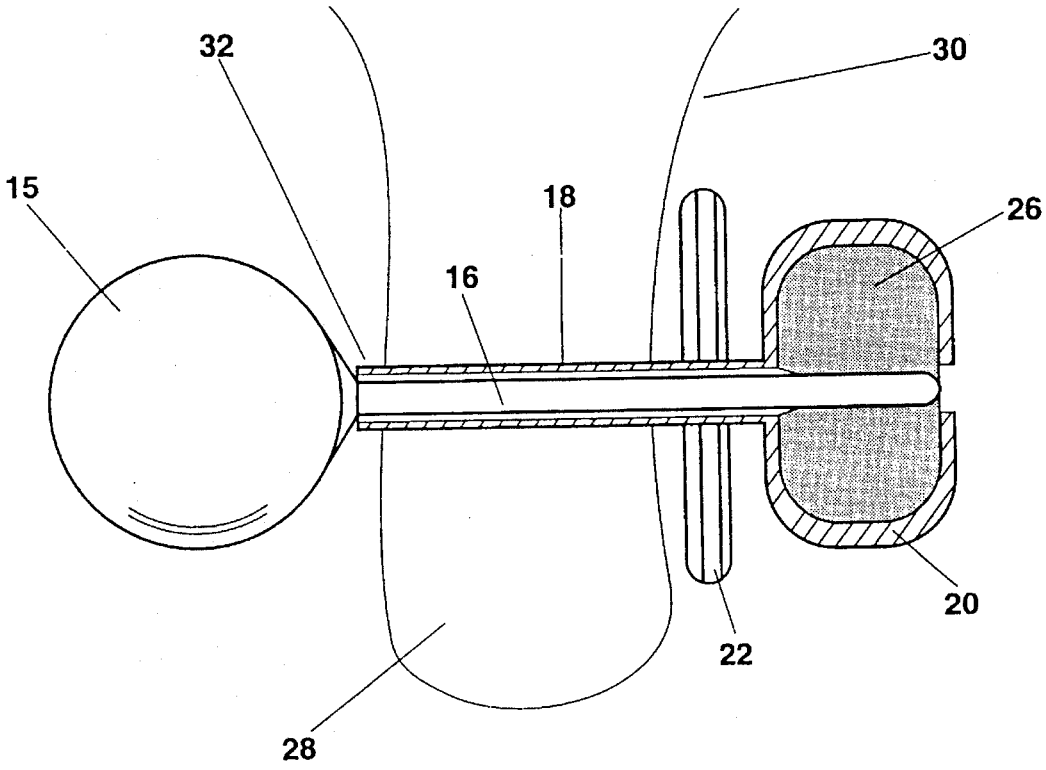
FIG. 3 is a side elevation, partially cut away, with the pierced earring in place.

Once so positioned, pin 14 shall be removed from cylinder 18 and replaced with post 16 of earring 10. Earring 10 shall be pressed into the lobe protector 12 until post 16 is securely gripped within the clutch portion 20 and ornament 15 contacts the front surface of cylinder 18 as seen in FIG. 3.

When necessary, disc 22 shall be advanced toward the rear surface 30 of the lobe in order to adjust for a thinner lobe or to provide increased snugness between ornament 15 and front lobe surface 32.

CONCLUSIONS, RAMIFICATIONS AND SCOPE OF INVENTION

Accordingly, the reader will see that the pierced-ear lobe protector of this invention can be used by the millions of women, little girls, and others who currently find the wearing of pierced earrings to be a problem due to allergy, discomfort, or irritation.

Moreover, the invention allows for a protective sleeve within the pierced lobe without the unsightliness of a front flange against the lobe.

The device provides a round, smooth tip which feeds easily from behind the lobe through to the front, more closely mimicking the angle of the lobe during the piercing procedure.

The invention remains in the ear permanently as long as there is a front ornamental earring to work in combination with it, allowing for comfortable wearing and multiple changes without irritation.

Little children will appreciate that they can sleep comfortably on their ears at bedtime or naptime since the invention provides a smooth, round clutch portion within which the sharp post is contained. Headphones, earphones, earmuffs, etc. can be worn more comfortably.

The one-piece configuration of the combined elements makes the invention easy to grasp and work with.

It permits a comfortable fit on earlobes of different thickness.

It enables the wearer to enjoy the fashion trends of costume jewelry earrings with no fear of allergic reaction to the metal posts.

While the above description contains many specificities, these should not be construed as limitations on the scope of the invention, but rather as an exemplification of one preferred embodiment thereof. Many other variations are possible. For example, the entire device can be formed from a non-metal such as plastic or nylon or a combination of hypoallergenic metals and non-metals. The gripping action within the clutch portion could be through mechanical means well known in the art. The disc could advance along the cylinder by means of serration or turning on threads. The head of the insertion pin could be other than ball-shaped. The clutch portion of the cylinder could be replaced by just a small flange and then a separate, conventional clutch used or attached.

Thus the scope of the invention should be determined not by the embodiment illustrated, but by the appended claims and their legal equivalents.

I claim:

1. A pierced-ear lobe protector comprising:

(a) an elongated, hollow, right circular cylinder having an internal bore with front and rear apertures, a rear portion, and a forward extremity, said cylinder terminating cleanly, without a flange, at said forward extremity adapted to be inserted into the back and through to the front of a wearer's pierced earlobe, said front aperture and internal bore of said cylinder of a size to allow reception of a conventional pierced ear type earring post, (b) clutching means attached at said rear portion of said cylinder whereby the post or wire of a pierced ear type earring may be threaded comfortably through the length of said internal bore of said cylinder and received and removably secured by said attached clutching means, (c) means for adjusting the length of said cylinder between said forward extremity and the wearer's rear lobe surface when the device is in position in wearer's earlobe, and (d) means for capping said front aperture of said hollow cylinder whereby a closed tip is formed for passage through the earlobe.

2. The lobe protector of claim 1 wherein said capping means comprises a ball-headed pin adapted to be inserted into said front aperture thereby forming a round, smooth tip for easier insertion into the pierced lobe.

3. The lobe protector of claim 1 wherein said attached clutching means comprises a bulbous enlargement of said cylinder, said bulbous enlargement having an internal cavity which contains gripping means.

4. The lobe protector of claim 3 wherein said gripping means includes an elastomeric substance.

* * * * *